US009039131B2

(12) United States Patent
Nishi et al.

(10) Patent No.: US 9,039,131 B2
(45) Date of Patent: May 26, 2015

(54) METHOD FOR PRODUCING INKJET HEAD, INKJET HEAD, METHOD FOR PRODUCING INTER-MEMBER ELECTRIFICATION STRUCTURE, AND INTER-MEMBER ELECTRIFICATION STRUCTURE

(75) Inventors: Yasuo Nishi, Hachioji (JP); Shigekazu Sakai, Tokyo (JP); Koujiro Yoshida, Machida (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/122,416

(22) PCT Filed: May 25, 2012

(86) PCT No.: PCT/JP2012/063455

§ 371 (c)(1),
(2), (4) Date: Nov. 26, 2013

(87) PCT Pub. No.: WO2012/165321

PCT Pub. Date: Dec. 6, 2012

(65) Prior Publication Data

US 2014/0092167 A1 Apr. 3, 2014

(30) Foreign Application Priority Data

May 27, 2011 (JP) ..... 2011-119725

(51) Int. Cl.

| | |
|---|---|
| ***B41J 2/16*** | (2006.01) |
| ***H01R 4/02*** | (2006.01) |
| ***B41J 2/14*** | (2006.01) |

(52) U.S. Cl.

CPC ..... *B41J 2/162* (2013.01); *B41J 2/14233* (2013.01); *B41J 2/161* (2013.01); *B41J 2/1623* (2013.01); *B41J 2002/14306* (2013.01); *B41J 2002/14491* (2013.01); *B41J 2202/18* (2013.01); *H01R 4/02* (2013.01)

(58) Field of Classification Search

CPC ..... B41J 2/162; B41J 2/1623; B41J 2/1631; B41J 2/1628; B41J 2/14024; B41J 2/1603; H01R 4/02

See application file for complete search history.

(56) References Cited

U.S. PATENT DOCUMENTS

| | | | | |
|---|---|---|---|---|
| 5,870,118 | A * | 2/1999 | Gunther et al. | 347/49 |
| 7,934,801 | B2 * | 5/2011 | Ito | 347/50 |

(Continued)

FOREIGN PATENT DOCUMENTS

| | | | |
|---|---|---|---|
| JP | 10-81018 | A | 3/1998 |
| JP | 10-135272 | A | 5/1998 |
| JP | 2004-136663 | A | 5/2004 |

(Continued)

OTHER PUBLICATIONS

International Search Report for International Application No. PCT/JP2012/063455, mailed Aug. 7, 2012, with English translation.

*Primary Examiner* — Manish S Shah
*Assistant Examiner* — Jeremy Delozier
(74) *Attorney, Agent, or Firm* — Cantor Colburn LLP

(57) ABSTRACT

A method for producing an inkjet head may include, the inkjet head having:

a head substrate having a plurality of piezoelectric elements, a wiring substrate having wiring lines through which electric power is fed to the respective piezoelectric elements through the drive electrodes, the method having:

pressure-welding the wiring substrate to the head substrate by heat through resin adhesive sections made of a thermosetting resin so that the drive electrodes are electrically connected to the wiring lines through solder bumps; and joining the head substrate to the wiring substrate, wherein a melting point $T_B$[° C.] of the solder bumps and a cure initiation temperature $T_R$[° C.] of the resin adhesion sections meet a relation ($T_R$[° C.]≤$T_B$[° C.]≤$T_R$+30[° C.]).

4 Claims, 3 Drawing Sheets

(56) References Cited

U.S. PATENT DOCUMENTS

| | | | | |
|---|---|---|---|---|
| 2004/0246312 | A1* | 12/2004 | Moriya et al. | 347/68 |
| 2005/0275694 | A1* | 12/2005 | Murata et al. | 347/70 |
| 2010/0177146 | A1* | 7/2010 | Takemura et al. | 347/68 |

FOREIGN PATENT DOCUMENTS

| | | | |
|---|---|---|---|
| JP | 2006-264322 | A | 10/2006 |
| JP | 2011-56919 | A | 3/2011 |
| WO | 2011132516 | A1 | 10/2011 |

* cited by examiner (a) $T_R$[℃] ≦ $T_B$[℃] ≦ $T_R$+30 [℃]

(b) $T_R$[℃] > $T_B$[℃]

METHOD FOR PRODUCING INKJET HEAD, INKJET HEAD, METHOD FOR PRODUCING INTER-MEMBER ELECTRIFICATION STRUCTURE, AND INTER-MEMBER ELECTRIFICATION STRUCTURE

This is the U.S. national stage of application No. PCT/JP2012/063455, filed on 25 May 2012. Priority under 35 U.S.C. §119(a) and 35 U.S.C. §365(b) is claimed from Japanese Application No.2011-119725, filed 27 May 2011, the disclosure of which is also incorporated herein by reference.

TECHNICAL FIELD

The present invention relates to an inkjet head and a method for producing an inkjet head, and more particularly to a method for producing an inkjet head which can realize high density of nozzles and prevent an ink discharge failure due to a connection failure of a wiring line, an inkjet head, a method for producing an inter-member electrification structure, and an inter-member electrification structure.

BACKGROUND

In recent years, to realize formation of high-precision/high-definition images, highly densely arranging a plurality of nozzles has been demanded.

In an inkjet head, besides arranging an ink common flow path in accordance with each nozzle column, a pressure chamber configured to provide an ink with a discharge pressure, a wiring line configured to feed electric power to a diaphragm provided in the pressure chamber, an individual flow path through which the ink is supplied from the common flow path to each pressure chamber are provided in accordance with each of the plurality of nozzles.

A droplet discharge head disclosed in Patent Document 1 is first formed by laminating and integrating a top plate member on an upper surface of a piezoelectric element substrate through a resin adhesion section.

The piezoelectric element substrate includes nozzles, pressure chambers, a diaphragm, and piezoelectric elements in order from a lower surface. On the other hand, the top plate member includes ink supply openings through which a liquid is supplied to the pressure chambers and wiring lines, and a liquid pool chamber is provided on an upper surface side thereof The liquid pool chamber communicates with the ink supply openings via through-holes pierced in the top plate member.

When the piezoelectric element substrate and the top plate member are pressure-welded by heat through a thermosetting resin, the wiring lines and the piezoelectric elements are electrically connected through bumps. Further, at the same time, since each resin adhesion section forms a hollow partition member, the partition member allows each ink supply opening and each pressure chamber to communicate with each other.

As described above, when the nozzles, the pressure chambers, the diaphragm, the piezoelectric elements, the wiring lines, and the liquid pool chamber are arranged so as to provide a layer structure in a vertical direction, the density of the nozzles can be increased.

PRIOR ART DOCUMENTS

Patent Documents

Patent Document 1: JP-A-2006-264322

SAMMARY OF THE INVENTION

Problem to be Solved by the Invention

However, unevenness or a warp is apt to be produced or a thickness is apt to vary in the piezoelectric element substrate or the top plate member, a gap between the piezoelectric element substrate and the top plate member that have been pressure-welded by heat through the thermosetting resin becomes uneven in some cases. Moreover, a formed height or physical properties of each bump are apt to vary.

As a result, the pump may be excessively compressed between the piezoelectric element substrate and the top plate member and flow out to the periphery, or a portion that cannot contact a member on the other side without reaching it is apt to be produced.

Therefore, a droplet discharge head according to Patent Document 1 has a problem that an ink discharge failure is apt to occur due to a connection failure of wiring lines.

As described above, in conventional examples, a technology that highly accurately perform energization at the time of joining the two members through the thermosetting resin and effecting energization with use of the bumps has not been established.

The present inventor has keenly examined this problem, paid attention to a relationship between a cure initiation temperature of the resin adhesion section and a melting point of each solder bump, and found out that an electrical connection defect at the time of pressure welding by heat can be avoided when this point meets a specific relationship, thereby bringing the present invention to completion.

Therefore, it is an object of the present invention to provide a method for producing an inkjet head which can realize an increase in density of nozzles and prevent an ink discharge failure due to a connection failure of wiring lines, an inkjet head, a method for producing an inter-member electrification structure, and an inter-member electrification structure.

Further, other objects of the present invention will become obvious based on the following description.

Means for Solving Problem

The object is achieved by each of the following inventions.

1. A method for producing an inkjet head, the inkjet head comprising:

a head substrate comprising: a plurality of pressure chambers that are provided in accordance with a plurality of nozzles configured to discharge an ink, respectively, and accommodate the ink discharged from the nozzles; a plurality of piezoelectric elements that are arranged in accordance with the pressure chambers, respectively, and apply a pressure used for discharging the ink in the pressure chambers from the nozzles; and a plurality of drive electrodes provided in accordance with the piezoelectric elements, respectively; and a wiring substrate having wiring lines through which electric power is fed to the respective piezoelectric elements through the drive electrodes, the method comprising:

pressure-welding the wiring substrate to the head substrate by heat through resin adhesive sections comprising a thermosetting resin so that the drive electrodes are electrically connected to the wiring lines through solder bumps; and joining the head substrate to the wiring substrate, wherein a melting point $T_B$[° C.] of the solder bumps and a cure initiation temperature $T_R$[° C.] of the resin adhesion sections meet a relation ($T_R$[° C.]≤$T_B$[° C.]≤$T_R$+30 [° C.]).

2. The method for producing an inkjet head according to 1, wherein the electrical connection between the drive electrodes and the wiring lines is electrical connection based on joining of the solder bumps and stud bumps, either the solder bumps or the stud bumps are provided on the drive electrode side, and the other bumps are provided on the wiring line side.

3. The method for producing an inkjet head according to 1 or 2, wherein the head substrate has ink introduction openings from which the ink is introduced into the pressure chambers, the wiring substrate has ink supply openings from which the ink is supplied to the ink introducing openings, and the ink introduction openings are arranged to communicate with the ink supply openings by the heat pressure welding via through holes formed in the resin adhesion sections.

4. The method for producing an inkjet head according to any one of 1 to 3, wherein, after the heat pressure welding, post-baking is performed at a temperature equal to or greater than the melting point $T_B$[° C.] of the solder bumps for a predetermined time.

5. An inkjet head obtained by the method for producing an inkjet head according to any one of 1 to 4.

6. A method for producing an inter-member electrification structure, comprising: pressure-welding a first member having a power feeding section provided thereto to a second member having a power receiving section provided thereto by heat through a resin adhesion section comprising a thermosetting resin so that the power feeding section is electrically connected to the power receiving section through a solder bump; and joining the first member to the second member, wherein a melting point $T_B$[° C.] of the solder bump and a cure initiation temperature $T_R$[° C.] of the resin adhesion section meet a relation ($T_R$[° C.]≤$T_B$[° C.]≤$T_R$+30 [° C.]).

7. An inter-member electrification structure obtained by the method for producing an inter-member electrification structure according to 6.

8. An inkjet head comprising the inter-member electrification structure according to 7.

Effect of the Invention

According to the present invention, it is possible to provide the method for producing an inkjet head which can realize an increase in density of nozzles and prevent an ink discharge failure due to a connection failure of wiring lines, the inkjet head, the method for producing an inter-member electrification structure, and the inter-member electrification structure.

DESCRIPTION OF THE PREFERRED EMBODIMENTS

A mode for carrying out the present invention will now be described with reference to the drawings.

Figure 1:
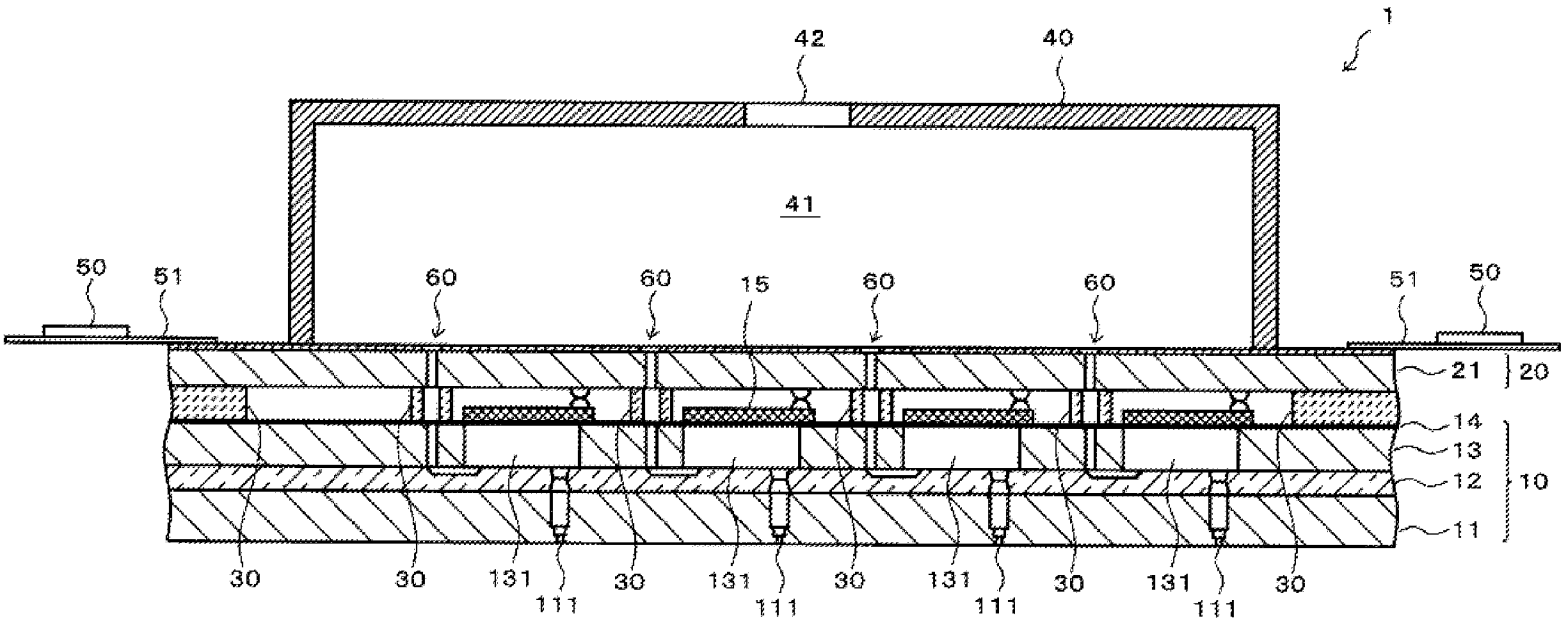
FIG. 1 is a cross-sectional view showing an example of an inkjet head according to the present invention.
Figure 2:
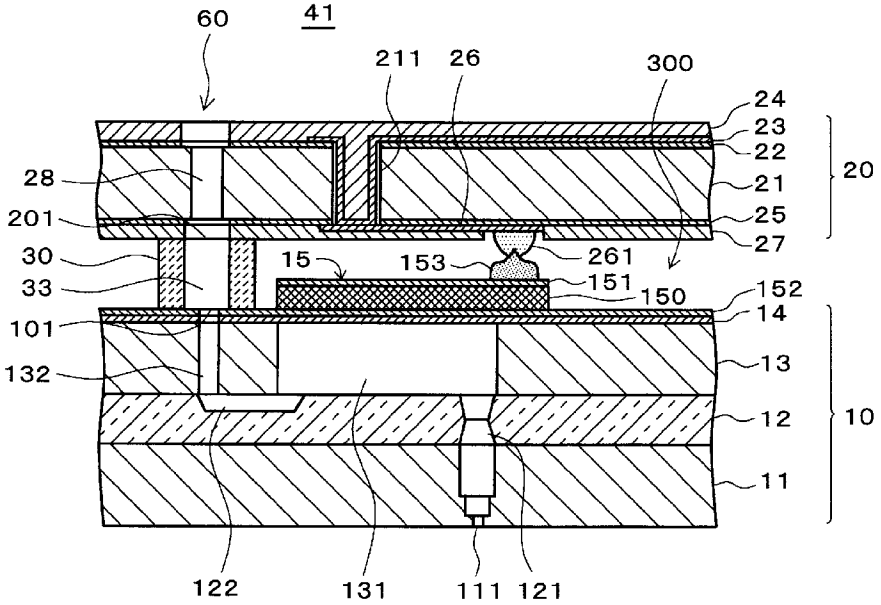
FIG. 2 is a partially enlarged cross-sectional view of FIG. 1.

FIG. 1 is a cross-sectional view showing an example of a droplet discharge head according to the present invention, and FIG. 2 is a partially enlarged cross-sectional view of the same.

In an inkjet head 1, a head substrate 10 and a wiring substrate 20 each of which has a planary rectangular shape are laminated and integrated through resin adhesion sections 30 provided therebetween.

A box-shaped manifold 40 is provided on an upper surface of the wiring substrate 20, and a liquid storage chamber 41 in which an ink is stored is formed between the manifold 40 and the upper surface of the wiring substrate 20. Reference numeral 42 denotes an ink supply opening through which the ink is supplied into the liquid storage chamber 41.

The head substrate 10 includes a nozzle plate 11 formed of an Si (silicon) substrate, an intermediate plate 12 formed of a glass substrate, a pressure chamber plate 13 formed of an Si (silicon) substrate, and a diaphragm 14 formed of an $SiO_2$ thin film from a lower side in the drawing. The nozzle plate 11 includes nozzles 111 that are opened toward a lower surface.

Here, pressure chambers 131 that accommodate the ink for discharge are formed in the pressure chamber plate 13 to be pierced in the vertical direction. Therefore, an upper wall of each pressure chamber 131 is constituted of the diaphragm 14, a lower wall of the same is constituted of the intermediate plate 12, and communication paths 121 communicating with the nozzles 111 in the pressure chambers 131 are bored and formed in the intermediate plate 12.

Reference numeral 15 denotes an actuator, and a piezoelectric element 150 formed of a thin film PZT is sandwiched between an upper electrode 151 and a lower electrode 152 that are drive electrodes configured to drive each piezoelectric element 150. The lower electrode 152 is provided in contact with a surface of the diaphragm 14, and the piezoelectric element 150 and the upper electrode 151 on the upper surface thereof are individually laminated on this lower electrode 152 in association with each pressure chamber 131 on one-on-one level.

Reference numeral 153 denotes a stud bump, and it is formed of gold or the like on the upper electrode 151 and protruded toward the wiring substrate 20. As the stud bump 153, a stud bump that is not molten at a temperature of a heat treatment such as heat pressure welding or the like is usually adopted.

The wiring substrate 20 has an upper wiring line 23 formed on an upper face of a substrate main body 20 constituted of an Si substrate through an insulator layer 22 made of $SiO_2$. An FPC (a flexible printed circuit board) 51 having a drive IC 50 mounted thereon is electrically connected to this upper wiring line 23 at an end portion of the wiring substrate 20 through, e.g., an AFC (an anisotropic conductive film). A wiring protective layer 24 made of $SiO_2$ is laminated on the upper surface of the upper wiring line 23.

Part of the upper wiring line 23 faces the lower surface of the substrate main body 21 via each through-hole 211 formed in the substrate main body 21, and it communicates with a lower wiring line 26 formed on the lower surface of the substrate main body 21 via an insulator layer 25 made of $SiO_2$. Part of the lower wiring line 26 is exposed in a wiring protective layer 27 made of $SiO_2$ that faces the actuator 15, and a plurality of solder bumps 261 made of, e.g., an Sn—Bi based eutectic solder are formed to protrude toward the head substrate 10.

Each resin adhesion section 30 is sandwiched between both the substrates 10 and 20 so as to form a predetermined gap between the upper surface of the head substrate 10 and the lower surface of the wiring substrate 20.

Here, the resin adhesion section 30 has a through-hole 33 that is pierced in the resin adhesion section 30 from the head substrate 10 side toward the wiring substrate 20 side.

Each through-hole 33 is provided in such a manner that the head substrate 10 and the wiring substrate 20 can be laminated and integrated and also an ink supply opening 201 provided in the lower surface of the wiring substrate 20 can communicate with an ink introduction opening 101 provided in the upper surface of the head substrate 10.

That is, an upper end of each through-hole 33 communicates with a through-hole 28 vertically pierced in the wiring substrate 20 via the ink supply opening 201 provided in the lower surface of the wiring substrate 20, and a lower end of the same communicates with a through-hole 132 vertically pierced in the pressure chamber plate 13 via the ink introduction opening 101 formed to be pierced in the lower electrode 152 and the diaphragm 14 of the head substrate 10.

Further, each communication path 122 communicating with this through-hole 132 and the inside of the pressure chamber 131 is concaved in a surface of the intermediate plate 12 (a joining surface relative to the pressure chamber plate 13), and the through-hole 28, the through-hole 33, the through-hole 132, and the communication path 122 constitute each individual flow path 60 through which the ink from the liquid storage chamber 41 included in the manifold 40 provided on the upper surface of the wiring substrate 20 is supplied to each pressure chamber 131. That is, one individual flow path 60 runs through one through-hole 33.

Although a resin forming the resin adhesion section 30 is not restricted in particular, a polyimide resin, an epoxy resin, an acrylic resin, and others can be preferably exemplified, and the polyimide resin is particularly preferable for uniforming the gap between the head substrate 10 and the wiring substrate 20 since it has excellent rigidity.

The resin adhesion section 30 can be formed by exposure or development with use of, e.g., a thermosetting photosensitive adhesive resin sheet. As a specific photosensitive adhesive resin sheet, for example, a photosensitive polyimide adhesive sheet manufactured by Toray Industries Inc. or a PerMX series (a trade name) manufactured by DuPont can be used.

A height of each resin adhesion section 30 is sufficiently higher than a thickness (a height) of the actuator 15, and hence a sufficient gap is formed between the upper side of the actuator 15 and the wiring substrate 20, whereby a mechanical deforming operation of the actuator 15 is not obstructed.

In a region between the head substrate 10 and the wiring substrate 20, a region where the resin adhesion section 30 is not present forms a gap 300.

The head substrate 10 and the wiring substrate 20 are laminated and integrated, the stud bums 153 on the head substrate 10 side and the solder bumps 261 on the wiring substrate 20 side form respective pairs in the gap 300, and each pair is independently in contact with other pairs. As a result, electric power from the drive IC 50 can be fed from the lower wiring line 26 to each piezoelectric element 150 through the upper electrode 151 of each actuator 15.

As described above, when the nozzles 111, the pressure chambers 131, the piezoelectric elements 150, the lower wiring lines 26, and the manifold 40 included in the inkjet head 1 are arranged to form the layer configuration in the vertical direction, the density of the nozzles 111 can be increased.

In the inkjet head 1 according to the present invention, the wiring substrate 20 and the head substrate 10 are pressure-welded by heat through each resin adhesion section 30 made of the thermosetting resin, whereby the head substrate 10 and the wiring substrate 20 are joined.

Furthermore, when the solder bumps 261 molten and deformed by this heat pressure-welding are brought into contact with the stud bumps 153, the upper electrodes 151 of the actuators 15 are electrically connected to the lower wiring lines 26.

When the resin adhesion section 30 is heated at the time of heat pressure-welding, its temperature increases. The present inventor has focused on a fact that viscosity [Pa·s] of each resin adhesion section 30 characteristically behaves in this temperature increasing process. It is to be noted that a change pattern of the viscosity [Pa·s] of the resin adhesion section 30 is substantially equal to a change pattern of rigidity of the resin adhesion section 30 relative to a pressure at the time of heat pressure welding.

First, the viscosity [Pa·s] of the resin adhesion section 30 gradually lowers during a first temperature increasing process from start of heating to reaching a cure initiation temperature $T_R$[° C.]. That is, the rigidity of the resin adhesion section 30 gradually decreases. The adhesion resin section 30 shows viscidity due to this reduction in rigidity (viscosity). Additionally, when the cure initiation temperature $T_R$[° C.] is reached, the viscosity [Pa·s] shows a minimum value. Heating is continued, and the viscosity [Pa·s] gradually increases during a second temperature increasing process from the cure initiation temperature $T_R$[° C.] to $T_R$+30[° C.]. That is, the rigidity of the resin adhesion section 30 gradually increases. When heating is further continued and the temperature of the resin adhesion section 30 reaches approximately $T_R$+50[° C.] to $T_R$+60[° C.], the viscosity does not rise even though the temperature increases, and irreversible curing is completed.

It is to be noted that the cure initiation temperature TR[° C.] of the resin adhesion section 30 means a temperature at which the viscosity of the resin adhesion section 30 shows a minimum vale at the time of temperature increase as described above, and it can be measured by differential scanning calorimetry (DSC).

In the present invention, when a melting point $T_B$[° C.] of the solder bumps 261 and the cure initiation temperature TR[° C.] of the resin adhesion section 30 meet a relation ($T_R$[° C.]≤$T_B$[° C.]≤$T_R$+30[° C.]), melting, i.e., a reduction in rigidity of the solder bumps 261 begins during the second temperature increasing process, namely, a process that the rigidity of the resin adhesion section 30 gradually increases which is also a process that the viscidity is shown without curing. Here, the melting point means a melting initiation temperature when the temperature increases due to heating.

As a result, the rigidity of both each resin adhesion section and each solder bump 261 can be prevented from being lowered, and a state that a change amount of rigidity of the resin adhesion section 30 is opposed to that of the solder bump 261 can be preferably formed.

The function and the effect will now be described in detail with reference to FIG. 3 that is a view showing an example of a change in rigidity of each resin adhesion section 30 and each solder bump 261 due to an increase in temperature.

Figure 3:
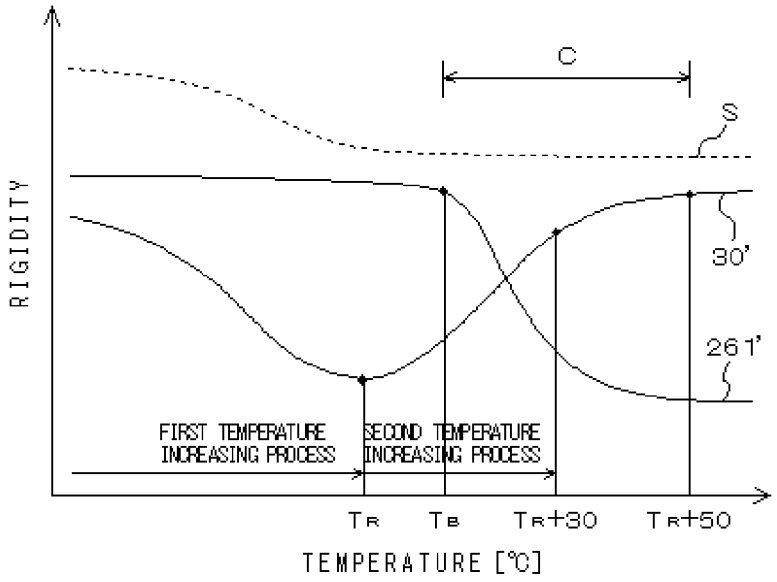
FIG. 3 is a view showing an example of a change in rigidity of each of a resin adhesion section and a solder bump involved by an increase in temperature.
Figure 3:
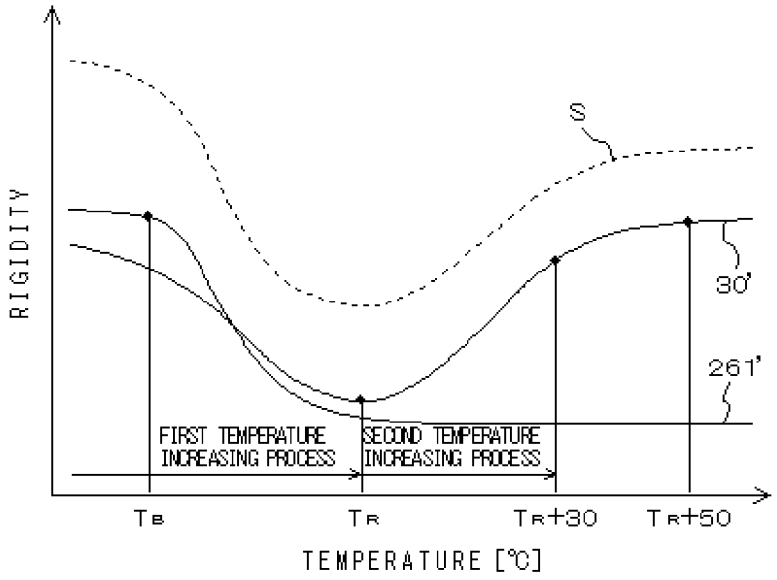

In FIG. 3, curved lines denoted by reference signs 30' and 261' represent rigidity of the resin adhesion section 30 and rigidity of the solder bump 261, respectively.

In the present invention, when the melting point $T_B$[° C.] of the solder bump 261 and the cure initiation temperature $T_R$[° C.] of the resin adhesion section 30 meet the relation ($T_R$[° C.]≤$T_B$[° C.]≤$T_R$+30[° C.]), as shown in FIG. 3(*a*), the state that both the rigidity 30' of the resin adhesion section 30 and the rigidity 261' of the solder bump 261 are lowered can be prevented from being formed, and a state that a change amount of the rigidity 30' of the resin adhesion section 30 becomes opposite to a change amount of the rigidity 261' of the solder bump 261 can be preferably formed.

That is, although the rigidity 30' of the resin adhesion section 30 gradually increases, a temperature at which irreversible curing is completed (which is usually $T_R$+50[° C.] to $T_R$+60[° C.]) is not reached, and each solder bump 261 is molten to lower the rigidity 261' while having the viscidity. As a result, unevenness or a warp of the head substrate 10 or the wiring substrate 20, a variation in thickness, and a variation in formed height of each solder bump 261 are absorbed by melting of each solder bump 261, and a secured electrically connected state that the end of each stud bump 153 bites into each solder bump 261 can be formed with respect to all the solder bumps 261 and all the stud bumps 153. At this time, although the resin adhesion section 30 is yet to be hardened, a temperature at which curing is completed is reached after each solder bump 261 is electrically connected to each stud bump 153, and the head substrate 10 and the wiring substrate 20 can be assuredly bonded to each other.

As a result, it is possible to remarkably avoid a state that each solder bump 261 is excessively compressed between the head substrate 10 and the wiring substrate 20 and flows out to the periphery or that each solder bump 261 does not reach a member on the other side and a non-contact portion is produced.

Therefore, the inkjet head according to the present invention can exercise an effect that density of the nozzles can be increased and an ink discharge failure due to a connection failure of the wiring lines can be avoided.

On the other hand, in terms of performing adhesion using the resin adhesion section 30 and adhesion using the solder bump 261 at the same time, there is another view, i.e., the rigidity of the solder bump 261 is decreased simultaneously with a reduction in rigidity of the resin adhesion section 30.

That is, as shown in FIG. 3(*b*), the melting point $T_B$[° C.] of the solder bump 261 is set to be lower than the cure initiation temperature $T_R$[° C.] of the resin adhesion section 30 ($T_R$[° C.]>$T_B$[° C.]), and the rigidity 261' of the solder bump 261 is decreased concurrently with a reduction in rigidity 30' of the resin adhesion section 30 based on this setting during the first temperature increasing process.

However, when the rigidity 30' of the resin adhesion section 30 and the rigidity 261' of the solder bump 261 are changed in parallel as described above, since the solder bump 261 is molten before reaching the cure initiation temperature $T_R$[° C.] of the resin adhesion section 30, the heat pressure welding may be continued for a long time during a period that the resin adhesion section 30 is cured, and hence an unfavorable event that the solder flows out to the periphery may possibly occur. As a result, an ink discharge failure due to a connection failure of the wiring lines is apt to occur.

On the other hand, according to the present invention, as shown in FIG. 3(*a*), since each solder bump 261 is molten during a period from start of curing to end of curing of the resin adhesion section 30, a heat pressure welding continuation for the molten solder bump 261 can be shortened, and the solder does not flow out.

Further, as shown in FIG. 3(*a*), in the state that a change amount of the rigidity 30' of the resin adhesion section 30 is opposite to a change amount of the rigidity 261' of the solder bump 261, since there is a tendency that the change amount of the rigidity 30' of the resin adhesion section 30 and the change amount of the rigidity 261' of the solder bump 261 are canceled out, an apparent sum (a broken line S in the drawing: apparent rigidity) of the rigidities 30' and 261' are fixed. This apparent rigidity S reflects the respective rigidities 30' and 261' of the resin adhesion section 30 and the solder bump 261, and hence it is substantially equal to rigidity between the head substrate 10 and the wiring substrate 20 relative to a pressure at the time of heat pressure welding.

As a result, in a region extending from the melting point $T_B$[° C.] of the solder bump 261 to the temperature at which irreversible curing of the resin adhesion section 30 is completed (which is usually $T_R$+50[° C.] to $T_R$+60[° C.]), a stability region C where curing of the resin adhesion section 30 advances while maintaining a state that the rigidity between the head substrate 10 and the wiring substrate 20 is fixed is formed.

It can be considered that this formation is also a cause of accurate uniforming of the gap between the head substrate 10 and the wiring substrate 20 in the present invention.

As shown in FIG. 3(*b*), when the rigidities 30' and 261' of the resin adhesion section 30 and the solder bump 261 are changed in parallel, since the change amounts of the respective rigidities 30' and 261' are potentiated without being canceled out, the apparent sum (a broken line S in the drawing: apparent rigidity) of the rigidities 30' and 261' shows precipitous drop and rise in a region from the melting point $T_B$[° C.] of the solder bump 261 to the temperature at which irreversible curing of the resin adhesion section 30 is completed, and such a stability region as that in the present invention is hard to be formed. That is, in a state that the rigidity between the head substrate 10 and the wiring substrate 20 relative to a pressure at the time of heat pressure welding precipitously changes, curing of the resin adhesion region 30 advances.

As a result, a variation in the head substrate 10 or the wiring substrate 20 cannot be stably absorbed by each region adhesion region 30 or each solder bump 261, and the gap between both the substrates 10 and 20 is apt to be non-uniform. Therefore, a portion where each solder bump 261 is excessively compressed and flows out to the periphery may be possibly produced between the head substrate 10 and the wiring substrate 20, and an ink discharge failure due to a connection failure of the wiring lines is apt to occur.

In the present invention, as described above, since the gap between the head substrate 10 and the wiring substrate 10 is accurately uniformed, when each resin adhesion section 30 is provided with the through-hole 33 that functions as an ink flow path, since the through-hole 33 is accurately connected to each of the ink introduction opening 101 of the head substrate 10 and the ink supply opening 201 of the wiring substrate 20, an effect of improving the ink discharge accuracy can be obtained.

In a method for producing an inkjet head according to the present invention, the wiring substrate 20 is pressure-welded to the head substrate 10 by heating via each resin adhesion section 30 made of a thermosetting resin. As a result, each piezoelectric element 150 and each lower wiring line 26 can be electrically connected through each solder bump 261, and the head substrate 10 is joined to the wiring substrate 20. At this time, since the melting point $T_B$[° C.] of the solder bump 261 and the cure initiation temperature $T_R$[° C.] of the resin adhesion section 30 meet the relation ($T_R$[° C.]≤$T_B$[° C.]≤$T_R$+30[° C.]) as described above, an increase in density of the nozzles can be realized as mentioned above, and an effect of avoiding an ink discharge failure due to a connection failure of the wiring lines can be obtained.

Furthermore, in the method for producing an inkjet head according to the present invention, after the head substrate 10 is pressure-welded to the wiring substrate 20 by heat, it is preferable to perform post-baking (a heat treatment) in a state that a pressure is not applied at temperature that is equal to or greater than the melting point $T_B$[° C.] of the solder bump 261 for a predetermined time.

In the present invention, when the post-baking is performed under a condition of a temperature that is equal to or greater than the melting point $T_B$[° C.] as described above, namely, in a state that each solder bump is molten, since the head substrate 10 and the wiring substrate 20 are free from the secured state due to each solder bump 261, and hence an effect of preferably eliminating stress strain between both the substrates can be obtained.

In the present invention, in case of connecting each solder bump 261 to each stud bump 153 and achieving electrical connection in particular, since the stud bump 153 supports the solder bump 261 even if the solder bump 261 is molten, and hence the solder bump 261 can be preferably prevented from flowing out. Moreover, post-baking can be thereby performed at a higher temperature for a longer time than in conventional examples, and a cross-linking reaction of polymers constituting the resin adhesion section 30 can be further advanced. As a result, chemical stability of the resin adhesion section 30 can be improved. In particular, when each resin adhesion section 30 is provided with the through-hole 33, namely, it forms an ink flow path, an effect of improving ink resisting properties can be obtained. As a result, an effect of providing the inkjet head having the ink resisting properties can be obtained.

Although the above description has been given as to the case where each solder bump 261 is provided on the wiring substrate 20 (the lower wiring line 26) side and each stud bump 153 is provided on the head substrate 10 (the upper electrode 151) side, the present invention is not restricted thereto, and each stud bump may be provided on the wiring substrate side 20 (the lower wiring 26) side and each solder bump may be provided on the head substrate 10 (the upper wiring line 26) side, for example.

Additionally, although the above description has been given as to the case where the upper electrode 151 of the piezoelectric element 150 is electrically connected to the lower wiring line 26 by joining the solder bump 261 to the stud bump 153, the present invention is not restricted thereto, and the upper electrode 151 of the piezoelectric element 150 may be electrically connected to the lower wiring line 26 through the solder bump.

Further, although the above description has been given as to the case where the heat pressing welding is carried out through each resin adhesion section 30 in the state that the head substrate 10 has the nozzles 111, the pressure chambers 131, and the piezoelectric elements 150 and the wiring substrate 20 has the lower wiring lines 26, the present invention is not necessarily restricted thereto, and it can be likewise applied to a case where the head substrate 10 does not have the nozzles 111, namely, the nozzle plate 11 is yet to be laminated at the time of the heat pressure welding, for example.

Furthermore, the present invention is not restricted to the above-described example of the inkjet head. The present invention can be preferably applied to a case where two members are joined through a thermosetting resin and energized through bumps. That is, in an inter-member electrification structure producing method for joining a first member and a second member, by which the first member having a power feeding section provided thereto and the second member having a power receiving section provided thereto are pressure-welded by heat through a resin adhesion section made of a thermosetting resin so that the power feeding section and the power receiving section can be electrically connected to each other through solder bumps, when a melting point $T_B$[° C.] of each solder bump and a cure initiation temperature $T_R$[° C.] of each resin adhesion section meet a relation ($T_R$[° C.]≤$T_B$[° C.]≤$T_R$+30[° C.]), an effect of highly accurately energizing the power feeding section and the power receiving section can be exercised. Moreover, an inter-member electrification structure obtained by this method for producing an inter-member electrification structure exerts an effect that the power feeding section and the power receiving section are highly accurately energized. Here, the first member, the power feeding section, the second member, and the power receiving section are not restricted in particular and, in case of the inkjet head 1, for example, the first member can be associated with the wiring substrate 20, the power feeding section can be associated with the lower wiring line 26, the second member can be associated with the head substrate 10, and the power receiving section can be associated with the piezoelectric element 150, respectively.

EXPLANATIONS OF LETTERS OR NUMERALS

1: inkjet head
10: head substrate
101: ink introduction opening
11: nozzle plate
111: nozzle
112: liquid flow path
12: intermediate plate
121: communication path
122: communication path
13: pressure chamber plate
131: pressure chamber
132: through-hole
14: diaphragm
15: actuator
150: actuator main body
151: upper electrode
152: lower electrode
153: stud bump
20: wiring substrate
201: ink supply opening
21: substrate main body
211: through-hole
22: insulator layer
23: upper wiring line
24: wiring protective layer
25: insulator layer
261: solder bump
27: wiring protective layer
28: through-hole
30: resin adhesive section
33: through-hole
300: gap
40: manifold
41: liquid storage chamber
42: ink supply opening
50: drive IC
51: FPC
60: individual flow path

The invention claimed is:

1. A method for producing an inkjet head, the inkjet head comprising:

a head substrate comprising: a plurality of pressure chambers that are provided in accordance with a plurality of nozzles configured to discharge an ink, respectively, and accommodate the ink discharged from the nozzles; a plurality of piezoelectric elements that are arranged in accordance with the pressure chambers, respectively, and apply a pressure used for discharging the ink in the pressure chambers from the nozzles; and a plurality of drive electrodes provided in accordance with the piezoelectric elements, respectively; and a wiring substrate having wiring lines through which electric power is fed to the respective piezoelectric elements through the drive electrodes, the method comprising:

pressure-welding the wiring substrate to the head substrate by heat through resin adhesive sections comprising a thermosetting resin so that the drive electrodes are electrically connected to the wiring lines through solder bumps; and joining the head substrate to the wiring substrate, wherein the electrical connection between the drive electrodes and the wiring lines is an electrical connection based on joining of the solder bumps and stud bumps which are not molten at a temperature of heat pressure welding, either the solder bumps or the stud bumps are provided on the drive electrode side, and the other bumps are provided on the wiring line side; and a melting point $T_B$[° C.] of the solder bump and a cure initiation temperature $T_R$[° C.] of the resin adhesion section meet a relation ($T_R$[° C.]≤$T_B$[° C.]≤$T_R$+30[° C.]).

2. The method for producing an inkjet head according to claim 1, wherein the head substrate has ink introduction openings from which the ink is introduced into the pressure chambers, the wiring substrate has ink supply openings from which the ink is supplied to the ink introducing openings, and the ink introduction openings are arranged to communicate with the ink supply openings by the heat pressure welding via through holes formed in the resin adhesion sections.

3. The method for producing an inkjet head according to claim 1, wherein, after the heat pressure welding, post-baking is performed at a temperature equal to or greater than the melting point $T_B$[° C.] of the solder bumps for a predetermined time.

4. An inkjet head comprising:

a head substrate comprising:

a plurality of pressure chambers that are provided in accordance with a plurality of nozzles configured to discharge an ink, respectively, and accommodate the ink discharged from the nozzles;

a plurality of piezoelectric elements that are arranged in accordance with the pressure chambers, respectively, and apply a pressure used for discharging the ink in the pressure chambers from the nozzles; and a plurality of drive electrodes provided in accordance with the piezoelectric elements, respectively; and a wiring substrate having wiring lines through which electric power is fed to the respective piezoelectric elements through the drive electrodes, wherein the wiring substrate and the head substrate are press-welded together by heat through resin adhesive sections comprising a thermosetting resin such that the drive electrodes are electrically connected to the wiring lines through solder bumps;

wherein the electrical connection between the drive electrodes and the wiring lines is an electrical connection based on joining of the solder bumps and stud bumps which are not molten at a temperature of heat pressure welding, either the solder bumps or the stud bumps are provided on the drive electrode side, and the other bumps are provided on the wiring line side; and a melting point $T_B$[° C.] of the solder bump and a cure initiation temperature $T_R$[° C.] of the resin adhesion section meet a relation ($T_R$[° C.]≤$T_B$[° C.]≤$T_R$+30[° C.]).

* * * * *